US006547545B1

(12) United States Patent
Jönsson, deceased et al.

(10) Patent No.: US 6,547,545 B1
(45) Date of Patent: Apr. 15, 2003

(54) ROTARY MACHINE FOR A COMPRESSION OR AN EXPANSION OF A GASEOUS WORKING FLUID

(76) Inventors: John Holger Jönsson, deceased, late of Borlänge (SE); by Claes Joakim Jonsson, legal representative, Tylla 36, S-781 94 Borlänge (SE); by Anna Carina Magdalena Jonsson, legal representative, Anders Lars gata 6, S-784 73 Borlänge (SE)

( * ) Notice: Subject to any disclaimer, the term of this patent is extended or adjusted under 35 U.S.C. 154(b) by 0 days.

(21) Appl. No.: 09/857,848

(22) PCT Filed: Dec. 9, 1999

(86) PCT No.: PCT/SE99/02305

§ 371 (c)(1),
(2), (4) Date: Nov. 8, 2001

(87) PCT Pub. No.: WO00/37779

PCT Pub. Date: Jun. 29, 2000

(30) Foreign Application Priority Data

Dec. 9, 1998 (SE) ..... 9804263

(51) Int. Cl.[7] ..... F01C 3/02; F04C 18/50
(52) U.S. Cl. ..... 418/195
(58) Field of Search ..... 418/195

(56) References Cited

U.S. PATENT DOCUMENTS

| | | | | |
|---|---|---|---|---|
| 2,327,089 A | * | 8/1943 | Bejeuhr | 418/195 |
| 2,413,209 A | | 12/1946 | Bejeuhr | 418/195 |
| 3,182,600 A | * | 5/1965 | Guinard | 418/195 |
| 3,232,236 A | | 2/1966 | Karavias | 418/195 |
| 3,632,239 A | * | 1/1972 | Zimmern | 418/195 |
| 3,708,249 A | | 1/1973 | Luthi | 418/195 |
| 4,003,348 A | * | 1/1977 | Suzuki et al. | 418/195 |
| 5,395,225 A | | 3/1995 | Johansson | 418/195 |

FOREIGN PATENT DOCUMENTS

| | | | | |
|---|---|---|---|---|
| FR | 1600666 | | 9/1970 | |
| JP | 6-42475 | * | 2/1994 | 418/195 |
| RU | 2059832 | | 5/1992 | |
| SE | 218304 | | 1/1968 | |
| SE | 371473 | | 1/1973 | |
| SE | 464531 | | 5/1991 | |
| WO | 8203428 | | 10/1982 | |

* cited by examiner

*Primary Examiner*—John J. Vrablik
(74) *Attorney, Agent, or Firm*—Crowell & Moring LLP

(57) ABSTRACT

A rotary machine for a compression or an expansion of a gaseous working fluid comprises a machine housing (10), a rotor (11) which is rotatably mounted within said housing and which, in its peripheral outer surface, is provided with at least one helically extending groove (14), having a depth varying along its length and serving as a flow passage for the working fluid, and a rotatable separation wheel (15) which is provided with a number of blades (17), evenly distributed in the circumferential direction of said wheel and serving as separation elements, successively insertable into the groove (14) of the rotor (11) and arranged to divide the groove (14) into a number of working chambers which follow one after the other in the longitudinal direction of the groove and which, during coordinated simultaneous rotation of the rotor (11) and the separation wheel (15), are brought to move along the groove (14) in the longitudinal direction thereof while successively changing their volume. The wheel blades (17) have peripheral edge portions (26), having an acute-angled wedge-shaped profile and terminating in thin sealing edges (27), moveable along the walls of the groove (14) and located at least approximately flush with the main surfaces (25) of the wheel blades (17), located at the high-pressure sides of the wheel blades (17).

10 Claims, 3 Drawing Sheets

ROTARY MACHINE FOR A COMPRESSION OR AN EXPANSION OF A GASEOUS WORKING FLUID

Figure 1:
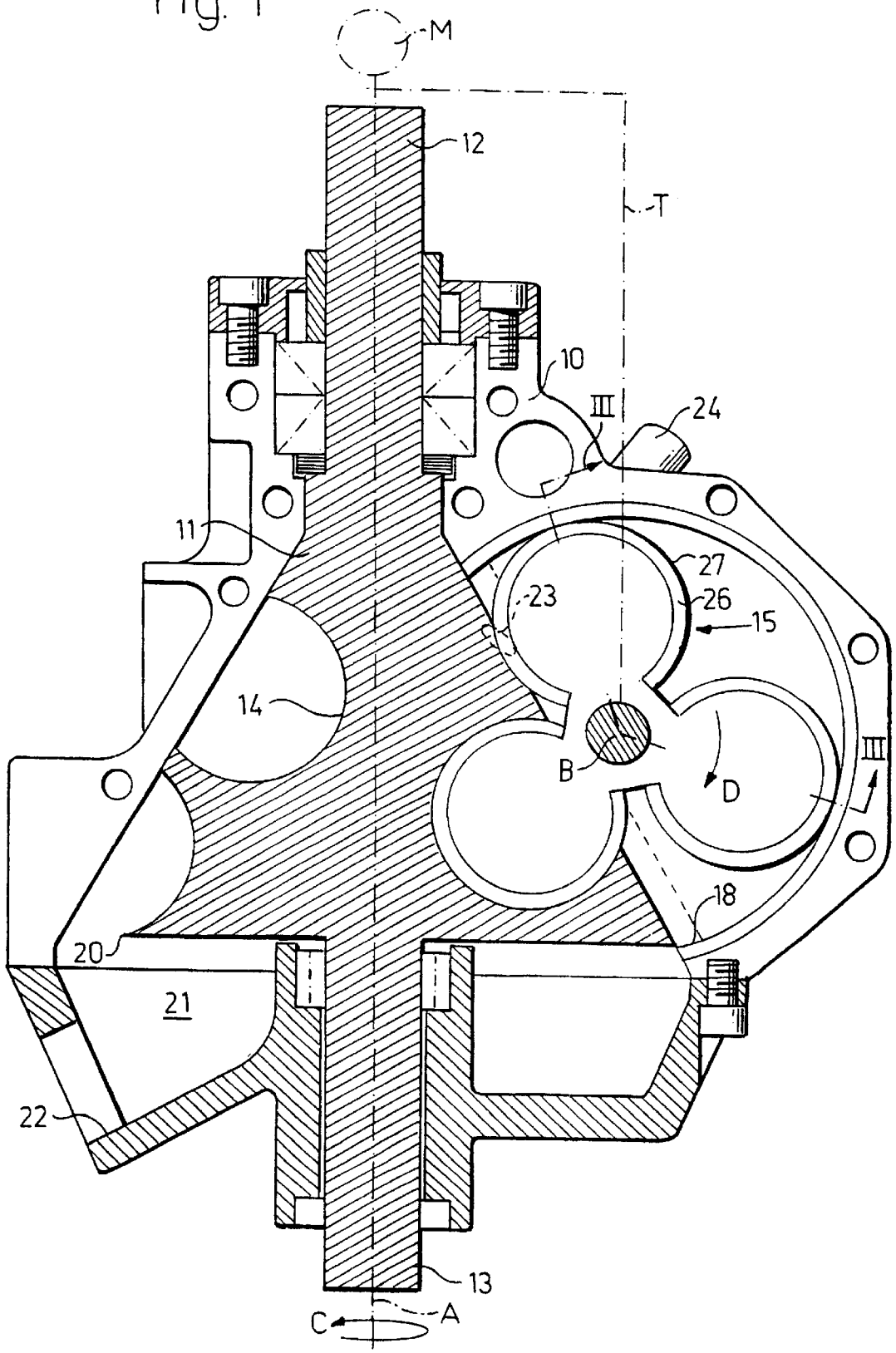

The present invention relates to a rotary machine for a compression or an expansion of a gaseous working fluid.

More particularly, the invention relates to such a machine of the kind comprising a machine housing, a rotor which is rotatably mounted within said housing and which, in its peripheral outer surface, is provided with at least one helically extending groove, having a depth varying along its length and serving as a flow passage for the working fluid, and a separation wheel which is mounted for rotation around a rotary axis, located at a distance from the rotary axis of the rotor and oriented in a direction deviating from the direction of the latter axis, and which comprises a central hub portion and a number of blades, protecting in at least approximately radial directions from said hub portion and evenly distributed in the circumferential direction of said wheel, said blades serving as separation elements, successively insertable into the groove of the rotor and arranged to divide the groove into a number of working chambers which follow one after the other in the longitudinal direction of the groove and which, during coordinated simultaneous rotation of the rotor and the separation wheel, are brought to move along the groove in the longitudinal direction thereof while successively changing their volume.

Machines of the above kind have been known for a very long time. Notwithstanding this fact, they have however not found any appreciable practical use. Most probably, the main reason is that previously one has not managed to avoid that the wheel blades, which serve as separation elements, are subjected to a hard wear, resulting in a rapid deterioration of their ability to separate the working chambers, located at opposite sides of said blades, in a satisfactory manner from each other.

Therefore, an object of the present invention. is to provide an improved rotary machine of the kind initially specified, in which the above-mentioned drawback of the machines previously known can be avoided.

The invention is based on the understanding that the main reason why, in the known machines, the wheel blades are subjected to a rapid wear is that, at their high-pressure sides, they have edge surfaces which, during the operation of the machine, are subjected to the action of the working fluid, which is present at the high-pressure side of the wheel blades and which is under high pressure, and that the wheel blades consequently are brought to bear very heavily against the walls of the rotor groove.

In order to avoid such an unfavourable action on the wheel blades from the pressure of the working fluid and a consequential rapid wear of said blades, according to the invention it is proposed that the wheel blades should have peripheral edge portions, having an acute-angled wedge-shaped profile and terminating into thin sealing edges, moveable along the walls of the groove and located at least approximately flush with the main surfaces of the wheel blades, located at the high-pressure sides of the wheel blades.

By providing the wheel blades with edge portions shaped in the above manner, it is possible easily to avoid that, at the high-pressure sides of the wheel blades, there will exist any edge surfaces which are exposed to the working fluid and upon which said fluid can exert an unfavourable action of the kind above described.

In a manner known per see, the separation wheel may be arranged to be brought to carry out a rotary movement, coordinated to the rotary movement of the rotor, through the action of forces transmitted to the separation wheel from the rotor via the walls of the rotor groove and the wheel blades. Naturally, if the separation wheel is driven in this manner, a certain contact pressure will occur between portions of the walls of the rotor groove and the wheel blades. However, this contact pressure is very low in comparison with the pressure that occurs in previously known machines due to the action of the pressure of the working fluid upon edge surfaces, located at the high-pressure sides of the wheel blades and exposed to said medium, and therefore, it need not cause any appreciable wear of the sealing edges of the wheel blades. Besides, such a wear can easily be counteracted by successively introducing small amounts of a lubricant into the rotor groove, for instance by means of the separation wheel.

However, in order to completely avoid the risk of any wear of the sealing edges of the separation wheel, caused by a contact between portions of the walls of the rotor groove and the wheel blades, the separation wheel may alternatively be arranged to be driven by separate driving means, for instance by an outer transmission, connected between the rotor and the separation wheel and preferably consisting of a cog-belt transmission which is free from backlash.

The wheel blades may have many different shapes. However, according to a preferred embodiment of the invention, they may advantageously have a part-circular shape. This means that the rotor groove may have a corresponding cross-sectional shape which, in practice, is very favourable as it will make it possible to produce the rotor groove in an astonishingly easy way.

The rotor may suitably have a generally frustoconical shape, at least along a substantial portion of its length. Such a shape of the rotor is favourable in several respects.

Furthermore, the separation wheel may preferably have three wheel blades.

Additionally, at their high-pressure sides, the wheel blades may suitably have plane main surfaces which are located in a plane perpendicular to the rotary axis of the separation wheel.

The invention also has for its purpose to provide a favourable new method for producing a rotor for a rotary machine of the kind initially specified.

The method, according to the invention proposed for said purpose, is primarily characterized in that the helically extending groove in the rotor is produced by subjecting a rotor blank to a successive machining along the desired extension length of the groove by means of a cutting or grinding tool which rotates around a rotary axis, oriented in a direction parallel to the intended direction for the rotary axis of the separation wheel, and which has an at least approximately wedge-shaped edge. By producing the rotor groove in this manner, one can make sure that, along its total length, the groove will get a shape very accurately adapted to the shape of the wheel blades, whereby it will be possible to reduce the dimensions of the inevitable leak gaps between the wheel blades and the walls of the groove to a minimum.

When carrying out the above method, the rotor blank may suitably be rotated around the intended rotary axis for the rotor during simultaneous coordinated parallel motion of the rotary axis of the tool relatively to the rotor blank along an arc-shaped path around the intended rotary axis for the separation wheel. If the wheel blades have a part-circular shape and the rotor groove then should have a corresponding cross-sectional shape, any further motion in addition to the above-mentioned parallel motion along a part-circular path need not be imparted to the rotary axis of the tool. However, if the wheel blades have another shape, for instance a part-elliptic shape, it is necessary to impart to the rotary axis of the tool, superimposed on said motion thereof, an additional parallel motion relatively to the rotor blank along an additional path, depending upon the desired cross-sectional shape of the rotor groove. While, in the first-mentioned case, it is possible to use a tool which has an effective radius, corresponding to the desired radius of the contour of the groove, and which constantly acts upon the groove contour along the entire length of said contour, in the last-mentioned case it is necessary to utilize a tool which has a substantially smaller effective radius and which through the superimposed additional parallel motion of the rotary axis of the tool is brought to act on the groove at successive locations along the contour of the groove.

Especially, if the groove is pre-formed in a cast rotor blank, a high surface finish of the groove may be obtained through machining the rotor blank in one single step, for instance by means of a suitable milling tool. However, if required, the groove may instead be produced through machining the rotor blank in at least two consecutive steps, comprising at least one coarse-machining step and at least one subsequent fine-machining step.

Figure 2:
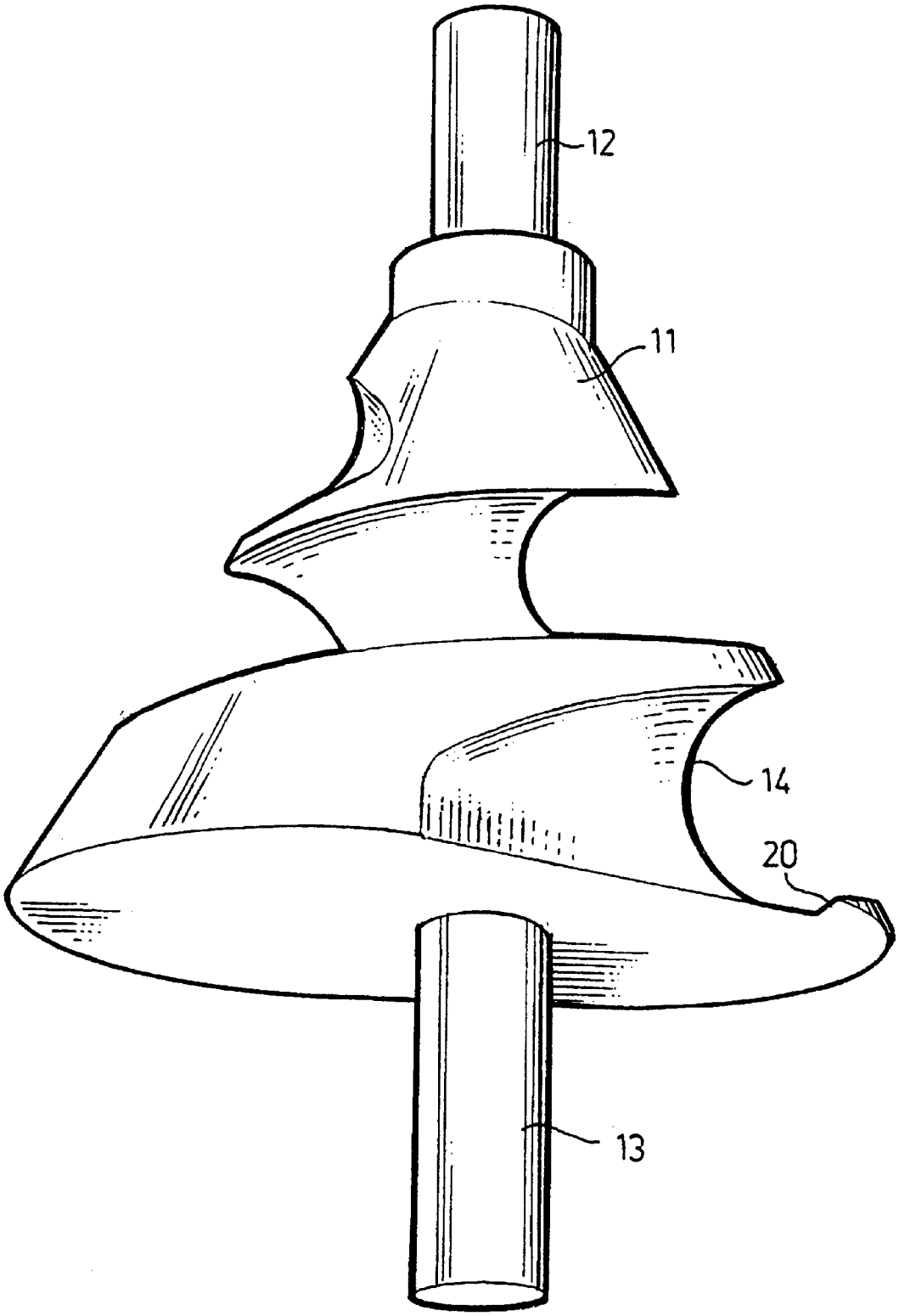
Figure 3:
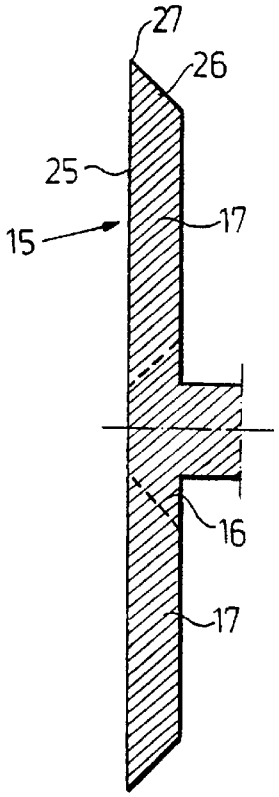
Figure 4:
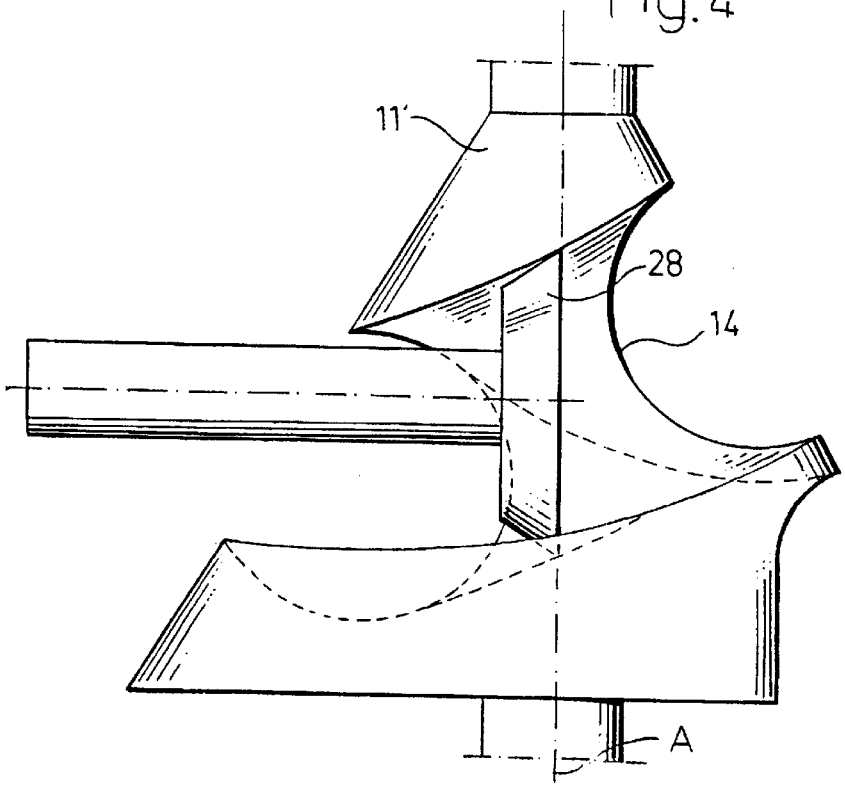

Below the invention is further described with reference to the accompanying diagrammatic drawings, in which:

FIG. 1 shows a longitudinal sectional view of a rotary machine according to an embodiment of the invention selected by way of example only, FIG. 2 shows a perspective view of a rotor forming part of the machine according to FIG. 1, FIG. 3 shows a partial view on an enlarged scale and in section taken along line III—III in FIG. 1, and FIG. 4 shows a side elevation of the rotor, illustrating the rotor during the progress of a machining operation effected by means of a milling tool.

The rotary machine shown in the drawings can be utilized at choice for a compression or an expansion of a gaseous working fluid. However, for the sake of simplicity, below it is described substantially only with reference to its function as a compressor.

The machine comprises a machine housing 10 and a rotor 11, having a generally frusto-conical shape and at its ends provided with axially projecting axle journals 12 and 13 by means of which rotor 11 is mounted in machine housing 10 for rotation relatively to said housing around a rotary axis A.

In its peripheral outer surface, rotor 11 is provided with a single helically extending groove 14 which serves as a flow passage for the working fluid and which has a depth and a cross-sectional area varying along the length of the groove. Reference numeral 15 designates a separation wheel which, in a manner not shown in detail, is mounted for rotation around a rotary axis B, located at a distance from the rotary axis A of rotor 11 and oriented in a direction perpendicular to the direction of the latter axis. Wheel 15 comprises a central hub portion 16 and three blades 17 of part-circular shape which project in radial directions from the hub portion and are evenly distributed in the circumferential direction of the wheel and which serve as separation elements which may be inserted into rotor groove 14 and by means of which said groove can be divided into a number of working chambers following one after the other in the longitudinal direction of the groove. When rotor 11 and wheel 15 are set in simultaneous coordinated rotation, these working chambers will move along groove 14 in the longitudinal direction of said groove while successively changing their volume.

In this connection, it should be noted that the wall of housing 10, facing the conical peripheral outer surface of the rotor, is arranged to close the groove 14 provided in the rotor in a radial outward direction. In said wall of housing 10, there is however provided a slot-shaped opening 18 through which wheel blades 17 may extend into rotor groove 14 and into which also hub portion 16 may project with a radially outer portion thereof.

At the thick-end of rotor 11, groove 14 terminates in an opening 20, provided in an end wall 19 of the rotor and extending in the peripheral direction of the rotor through a substantial angle, for instance about 90°. This opening 20 communicates with an annular chamber 21, provided in housing 10 and into which a gaseous working fluid, intended to be compressed, for instance air, may be supplied through an inlet passage 22. Near the thin-end of rotor 11 an opening 23, shown in dashed lines, is provided in the adjacent wall of housing 10. Said opening communicates with an outlet duct 24 through which working fluid compressed in the machine may be discharged therefrom.

When the machine is to be started, by means of a motor M connected to rotor 11, the rotor is set to rotate in the direction indicated by arrow C in FIG. 1, i.e. in a counter-clockwise direction as seen from below in FIG. 1. The required driving energy may suitably be supplied to rotor 11 through axle journal 12 which is located at the thin-end of the rotor and which preferably should be mounted in an axially fixed state in housing 10.

Separation wheel 15 is simultaneously set to rotate in the direction indicated by arrow D in FIG. 1, i.e. in a clockwise direction according to FIG. 1. As a consequence of the fact that wheel 15 has three wheel blades 17 which are intended to cooperate with rotor groove 14, the rotary speed of wheel 15 will amount to one third of the rotary speed of the rotor. Wheel 15 may be driven either through a direct application of forces on said wheel from rotor 11 via the walls of rotor groove 14 and the peripheral edges of wheel blades 17 or by separate driving means, for instance an outer transmission T, connected between rotor 11 and wheel 15 and preferably consisting of a cog-belt transmission which is free from backlash.

When the machine is operating, the working fluid will be sucked into rotor groove 14 via passage 22, chamber 21 and opening 20. Thereupon, during its passage through groove 14, the working fluid will undergo a successive compression in order then to be discharged from the groove in a compressed state via opening 23 and duct 24.

In order, during the operation of the machine, to avoid that the pressure of the working fluid will have an unfavourable effect on the wheel blades 17 and cause a rapid wear of said blades, the wheel blades are shaped in a special way. More particularly, the wheel blades, which at their high-pressure sides have plane main surfaces 25, located in a plane perpendicular to the rotary axis B of wheel 15, are provided with peripheral edge portions 26, having an acute-angled wedge-shaped profile and terminating into thin sealing edges 27 which are moveable along the walls of groove 14 and which are located at least approximately flush with said main surfaces. Hereby, it is avoided that, at the high-pressure sides of wheel blades 17, there will occur any edge surfaces which are exposed to the working fluid under high pressure, existing at said sides of the wheel blades, and upon which the working fluid may have an unfavourable pressure effect of the kind above described.

Sealing edges 27 need not necessarily be absolutely sharp-edged but may also be slightly rounded. However, in any case, they must be so thin that their outer portions, located closest to the walls of rotor groove 14, will be located at a negligible distance from the plane in which the main surfaces of the wheel blades at the high-pressure sides of said blades are located.

The above design of the separation wheel 15 permits groove 14 in rotor 11 to be produced in a very favourable manner, diagramatically illustrated in FIG. 4. Thus, the groove may be produced by subjecting a rotor blank 11', which preferably consists of a casting and is provided with a preshaped groove, to a successive machining operation along the desired extension length of groove 14 by means of a rotating cutting or grinding tool 28 having a wedge-shaped edge, preferably a milling tool, which is rotated around a rotary axis E, oriented in a direction parallel to the intended direction for the rotary axis B of separation wheel 15.

Rotor blank 11' may in this case be rotated around the intended rotary axis A for rotor 11 while the rotary axis E of the rotating tool 28 simultaneously is brought to carry out a coordinated parallel motion relatively to the rotor blank along an arc-shaped path around the intended rotary axis B for separation wheel 15.

The invention is not restricted to the embodiment above described and shown in the drawings. Instead, many other embodiments are feasible within the scope of the invention as defined in the following claims. For instance, it could be mentioned that the wheel blades need not have a part-circular shape. Thus, instead they may for instance have a part-elliptic shape. In this case, during the production of groove 14 in rotor blank 11', it is necessary to utilize a tool 28 having a substantially smaller diameter and to impart to the rotary axis E of the tool, superimposed on the parallel motion of said axis along an arc-shaped path, an additional parallel motion relatively to the rotor blank along a path depending upon the desired cross-sectional shape of the rotor groove. Furthermore, it could also be mentioned that the rotary axis of the separation wheel need not be oriented in a direction perpendicular to the direction of the rotary axis of the rotor but may also be oriented in another direction, deviating from the first mentioned direction.

Finally, it could be mentioned that, if the machine above described is to be utilized for an expansion of a gaseous fluid under high pressure, i.e. as a turbine, instead of as a compressor, said working fluid is supplied through duct 24. The rotor is then caused to rotate by the supplied working fluid. The expanded working fluid is discharged through opening 22. The energy extracted during the passage of the working fluid through the machine may be utilized to drive any desired load connected to the rotor.

We claim:

1. A rotary machine for a compression or an expansion of a gaseous working fluid, said machine comprising a machine housing, a rotor which is rotatably mounted within said housing and which has a peripheral outer surface provided with a single helically extending groove having a depth varying along its length and serving as a flow passage for the working fluid, and a separation wheel which is mounted for rotation around a rotary axis located at a distance from the rotary axis of the rotor and oriented in a direction deviating from the direction of the rotary axis of the rotor, said separation wheel comprising a central hub portion and a number of blades projecting in at least approximately radial directions from said hub portion and evenly distributed in the circumferential direction of said wheel, said blades serving as separation elements, successively insertable into the groove of the rotor and arranged to divide the groove into a number of working chambers which follow one after another in the longitudinal direction of the groove and which, during coordinated simultaneous rotation of the rotor and the separation wheel, are brought to move along the groove in the longitudinal direction thereof while successively changing their volume, wherein the wheel blades have peripheral edge portions having an acute-angled wedge-shaped profile and terminating in thin sealing edges moveable along walls of the groove and located at least approximately flush with main surfaces of the wheel blades located on high-pressure sides of the wheel blades; and wherein the said profile of said edge portion extends along the entire blade peripheral portion movable along the walls of the groove.

2. A rotary machine according to claim 1, wherein the separation wheel is arranged to be brought to carry out a rotary movement, coordinated to the rotary movement of the rotor, through the action of forces transmitted to the separation wheel from the rotor via the walls of the rotor groove and the wheel blades.

3. A rotary machine according to claim 1, wherein the wheel blades have a part-circular shape.

4. A rotary machine according to claim 1, wherein the separation wheel has three wheel blades.

5. A rotary machine according to claim 1, wherein the wheel blades have planar main surfaces at their high-pressure sides, said planar surfaces being located in a plane perpendicular to the rotary axis of the separation wheel.

6. A rotary machine according to claim 1, wherein the separation wheel is arranged to be driven by separate driving means.

7. A rotary machine according to claim 6, wherein the separation wheel is arranged to be driven by an outer transmission connected between the rotor and the separation wheel.

8. A rotary machine for a compression or an expansion of a gaseous working fluid, said machine comprising a machine housing, a rotor which is rotatably mounted within said housing and which has a peripheral outer surface provided with a single helically extending groove having a depth varying along its length and serving as a flow passage for the working fluid, and a separation wheel which is mounted for rotation around a rotary axis located at a distance from the rotary axis of the rotor and oriented in a direction deviating from the direction of the rotary axis of the rotor, said separation wheel comprising a central hub portion and a number of blades projecting in at least approximately radial directions from said hub portion and evenly distributed in the circumferential direction of said wheel, said blades serving as separation elements, successively insertable into the groove of the rotor and arranged to divide the groove into a number of working chambers which follow one after another in the longitudinal direction of the groove and which, during coordinated simultaneous rotation of the rotor and the separation wheel, are brought to move along the groove in the longitudinal direction thereof while successively changing their volume, wherein the wheel blades have peripheral edge portions having an acute-angled wedge-shaped profile and terminating in thin sealing edges moveable along walls of the groove and located at least approximately flush with main surfaces of the wheel blades located on high-pressure sides of the wheel blades; wherein the said profile of said edge portion extends along the entire blade peripheral portion movable along the walls of the groove, and wherein the rotor has a generally frusto-conical shape at least along a substantial portion of its length.

9. A rotary machine for a compression or an expansion of a gaseous working fluid, said machine comprising a machine housing, a rotor which is rotatably mounted within said housing and which has a peripheral outer surface provided with a single helically extending groove having a depth varying along its length and serving as a flow passage for the working fluid, and a separation wheel which is mounted for rotation around a rotary axis located at a distance from the rotary axis of the rotor and oriented in a direction deviating from the direction of the rotary axis of the rotor, said separation wheel comprising a central hub portion and three wheel blades projecting in at least approximately radial directions from said hub portion and evenly distributed in the circumferential direction of said wheel, said blades serving as separation elements, successively insertable into the groove of the rotor and arranged to divide the groove into a number of working chambers which follow one after another in the longitudinal direction of the groove and which, during coordinated simultaneous rotation of the rotor and the separation wheel, are brought to move along the groove in the longitudinal direction thereof while successively changing their volume, wherein the wheel blades have peripheral edge portions having an acute-angled wedge-shaped profile and terminating in thin sealing edges moveable along walls of the groove and located at least approximately flush with main surfaces of the wheel blades located on high-pressure sides of the wheel blades; wherein the said profile of said edge portion extends along the entire blade peripheral portion movable along the walls of the groove, and wherein the rotor has a generally frusto-conical shape at least along a substantial portion of its length.

10. A rotary machine for a compression or an expansion of a gaseous working fluid, said machine comprising a machine housing, a rotor which is rotatably mounted within said housing and which has a peripheral outer surface provided with at least one helically extending groove having a depth varying along its length and serving as a flow passage for the working fluid, and a separation wheel which is mounted for rotation around a rotary axis located at a distance from the rotary axis of the rotor and oriented in a direction deviating from the direction of the rotary axis of the rotor, said separation wheel comprising a central hub portion and three wheel blades having a part-circular shape and projecting in at least approximately radial directions from said hub portion and evenly distributed in the circumferential direction of said wheel, said blades serving as separation elements, successively insertable into the groove of the rotor and arranged to divide the groove into a number of working chambers which follow one after another in the longitudinal direction of the groove and which, during coordinated simultaneous rotation of the rotor and the separation wheel, are brought to move along the groove in the longitudinal direction thereof while successively changing their volume, wherein the wheel blades have peripheral edge portions having an acute-angled wedge-shaped profile and terminating in thin sealing edges moveable along walls of the groove and located at least approximately flush with main surfaces of the wheel blades located on high-pressure sides of the wheel blades; wherein the said profile of said edge portion extends along the entire blade peripheral portion movable along the walls of the groove, and wherein the rotor has a generally frusto-conical shape at least along a substantial portion of its length.

* * * * *